US006015218A

United States Patent [19]

Snell

[11] Patent Number: 6,015,218

[45] Date of Patent: Jan. 18, 2000

[54] LIGHTING DISPLAY AND ASSEMBLY KIT

[76] Inventor: Lloyd D. Snell, 2017 Stevenson, Ames, Iowa 50010

[21] Appl. No.: 09/111,254

[22] Filed: Jul. 3, 1998

Related U.S. Application Data

[63] Continuation-in-part of application No. 08/668,902, Jun. 24, 1996, abandoned.

[51] Int. Cl.[7] ..... F21V 21/00

[52] U.S. Cl. ..... 362/249; 362/252; 362/806

[58] Field of Search ..... 362/121, 227, 362/249, 252, 806, 807, 808

[56] References Cited

U.S. PATENT DOCUMENTS

| | | | |
|---|---|---|---|
| 3,446,953 | 5/1969 | Mylonas | 362/252 |
| 4,657,800 | 4/1987 | Long | 362/806 |
| 5,624,181 | 4/1997 | Miller et al. | 362/252 |
| 5,842,773 | 12/1998 | Krrebs | 362/249 |

*Primary Examiner*—Darren E. Schuberg
*Attorney, Agent, or Firm*—James M. Ritchey

[57] ABSTRACT

A versatile lighting decoration has a display sheet fabricated from a transparent and resilient film. An outline of a predetermined shape is marked on the film and a plurality of apertures placed through and along the outline. A string of lights having multiple bulbs, each bulb fitted within a socket adapted for gripping the display sheet, is releasably secured in the apertures to generate a lighted image of the predetermined shape that may be highlighted by one or more additional strings of lights.

5 Claims, 4 Drawing Sheets

LIGHTING DISPLAY AND ASSEMBLY KIT

CROSS-REFERENCE TO RELATED APPLICATIONS

This is a continuation-in-part of application Ser. No. 08/668,902 filed on Jun. 24, 1996 now abandoned.

BACKGROUND OF THE INVENTION

1. Field of the Invention

A display system comprising a panel and an array of lights with adapted sockets for gripping the panel is disclosed. More specifically, the display system is often utilized during holidays and includes a transparent panel with highlighted markings and one or more strings of lights which mount into apertures in the panel to form recognizable patterns. Additionally, the display system is easily assembled by children and may be positioned in various locations, both indoor and outdoor.

2. Description of the Background Art

Related in U.S. Pat. No. 3,446,953 is an electrical window decoration having transparent sheets divided into sections shaped to fit around the inner perimeter of a window. Included in each section is a permanent printed wiring circuit having a plurality of specialized sockets for holding light bulbs. Fasteners mechanically and electrically connect the sections together.

U.S. Pat. No. 4,110,818 discloses an illuminated flag or pennant. Fiber optic cables deliver light patterns to the surface of the flag or pennant.

An indoor decorative wall hanging is described in U.S. Pat. No. 4,966,793. Included is an opaque or nontransparent folding, non-resilient panel that has apertures for receiving the sockets of light bulbs from within a string of decoration lights. A pattern is printed on an outwardly facing surface of the panel in which the lights show as ornaments. A layout guide for positioning the light sockets within the string is printed on an inwardly facing surface.

U.S. Pat. No. 5,077,646 presents an ornamental lighting frame comprising a preshaped frame with a plurality of openings. Fitted within the openings are clips for holding a string of lights to present an object in low density lighting patterns.

Presented in U.S. Pat. No. B1 5,113,325 is a light assembly kit for illuminating an article of clothing. LEDs are positioned on a garment to enhance various graphic illustrations placed on the garment.

A decorative light grid is disclosed in U.S. Pat. No. 5,213,409. A grid having bulb socket gripping means is provided. A larger structure may be formed by connecting together a plurality of grids to produce a low density light display.

U.S. Pat. No. 5,424,925 describes a decorative lighting system and method of use that comprises webbing of electrically conductive filaments that glow upon the application of current to the web.

An illuminated flag is supplied in U.S. Pat. No. 5,477,437. Within a pocket formed between two layers of a flag is contained a string of lights. The bulbs of the lights project through the material of the flag and are held in place by suitable metal grommets.

The device summarized above are generally costly to produce, difficult to assembly, and require a level of assembly expertise above that possessed by children. Generally, unlike the subject invention in which the lights are the artwork, the prior art lights are used only to accent the structural and artistic aspects of the underlying supports to produce the overall appearance of the prior art products.

The foregoing patents reflect the state of the of which the applicant is aware and are tendered with the view toward discharging applicant's acknowledged duty of candor in disclosing information which may be pertinent in the examination of this application. It is respectfully submitted, however, that none of these patents teach or render obvious, singly or when considered in combination, applicant's claimed invention.

SUMMARY OF THE INVENTION

Many advantages over the prior art and objects for the present invention exist as listed immediately below:

1. The subject invention uses inexpensive "miniature" lights having specifically designed film or panel gripping sockets that releaseably hold the supporting film.
2. The subject invention utilizes lights that create the image and does not rely on non-lighted features to produce the desired display.
3. The subject invention is easy to work with and assembly can be done by children, usually age eight and up.
4. The subject invention is mostly transparent and therefore when placed in a window the subject device allows light to enter during daylight hours.
5. In addition to the lights, the remaining portions of the subject invention are fabricated from inexpensive materials.
6. The subject invention is easily shipped in a relatively small container.
7. The subject invention is lightweight and easily hung in varied locations.
8. The subject invention is resilient and easily mounts on uneven or textured surfaces.
9. The subject invention is produced from materials that resist weathering and withstand a reasonably wide temperature range, therefore permitting the subject device to be used for either an indoor or outdoor display.
10. The subject invention is easy to disassemble and/or store, thereby providing a continuing project that can be shared repeatedly by a family during relevant holiday seasons or other events.
11. The subject invention uses a display sheet that is elastic or resilient and therefore the sheet holds or grips the specifically designed light sockets in a manner that permits high density lighting patterns without the aid of additional fastening devices.

Disclosed is a versatile lighting decoration that comprises a display sheet fabricated from a transparent and resilient film. Frequently, the transparent and resilient film is fabricated from polyvinyl chloride or an equivalent material. Usually, the film has at least an upper and a lower edge. An outline of a predetermined shape is denoted or marked on the film, often by a silk screen procedure or similar method. A series of first apertures are formed in the film and positioned along the outline of the predetermined shape.

At least one string of primary lights is employed to light the display. Each string of lights has a plurality of bulbs and associated sockets with each socket adapted for gripping the film or panel. The film gripping sockets releasably fit into the apertures in the film or panel to produce a lighted image of the shape. The means utilized to hold each socket within its aperture in the film (grip the film or panel) comprises first and second opposing segmented ridges that releaseably "pinch" or secure the film or panel between them. Standard wiring connects the bulbs together, with the wiring terminating in a common plug for receiving power. Commonly, to generate additional attractive qualities such as depth and solidity to the lighted shape, a plurality of second apertures are formed and positioned within the outline of the predetermined shape. A string of secondary lights having a plurality of bulbs and associated film gripping sockets are then utilized to fill the second apertures. Each of the film gripping sockets within the string of secondary lights releasably fit into one of the secondary apertures in an equivalent manner as with the primary light film gripping sockets.

Usually, a first support strip is secured at the upper edge of the film and a second support strip is secured at the lower edge of the film. These strips serve to prevent distortions in the film and to provide a method of hanging the subject invention in a window, on a wall, or other suitable location. The exact form of the support strip and its association with the film is variable and may range from a pressure fitted coupling over the film to other coupling interactions such as gluing, molding, hooking, snapping, and the like of equivalent stabilizing members. Additionally, means for hanging the film are supplied, wherein the hanging means releasably couples with the first or upper support strip.

Preferably, means are provided for securing the plug from the string of lights to the transparent and resilient film. Often, the plug securing means comprises a pair of apertures formed in the film and an anchor strap that tightens through the apertures and about the cord. Alternate plug securing means are contemplated and include systems such as cable ties and adhesive cable tie mounts (available from Calterm, Inc., El Cajon, Calif. 92020-1197).

Since the subject invention is visualized as being utilized for a festive event or holiday, the components of the subject invention are often supplied in the form of a kit that can be used as a focusing pre-activity for the event or holiday. The kit for assembling the subject lighting decoration, comprises a transparent and resilient film having upper and lower edges; an outline of a predetermined shape denoted on the transparent and resilient film; a plurality of first apertures positioned along the outline of the predetermined shape; at least one string of primary lights having a plurality of bulbs and associated film gripping sockets connected together by wiring terminating in a plug, wherein each of the sockets within the string of primary lights releasably fits into one of the first apertures; a first support strip secured proximate the upper edge of the transparent and resilient film; a second support strip secured proximate the lower edge of the transparent and resilient film; means for hanging the transparent and resilient film; and means for instructing the user in a assembling the lighting decoration. The instructional means often comprises an instruction sheet or sheets that, in addition to actual mechanical assembly directions, indicate to the user a possible design plan for placing different colored lights in specific apertures.

Other objects, advantages, and novel features of the present invention will become apparent from the detailed description that follows, when considered in conjunction with the associated drawings.

DESCRIPTION OF THE PREFERRED EMBODIMENT

Referring now to FIGS. 1–5, there is shown a preferred embodiment of a lighting decoration that may be displayed in various settings that can be either indoors or in an outside environment. Decorations or displays that contain white or colored lights are utilized for advertising, noting special events, and for observing holidays. By way of example and not by way of limitation, an appropriate lighting decoration may be exhibited to celebrate Christmas. A typical lighting decoration for the Christmas season would include, but not be limited to: wreaths, Christmas trees, sleighs with reindeer, Santa Claus, snowpersons, and the like. To illustrate the subject invention, a wreath has been selected to be the predetermined shape that will be outlined for lighting, however, shapes are equally acceptable.

Figure 1:
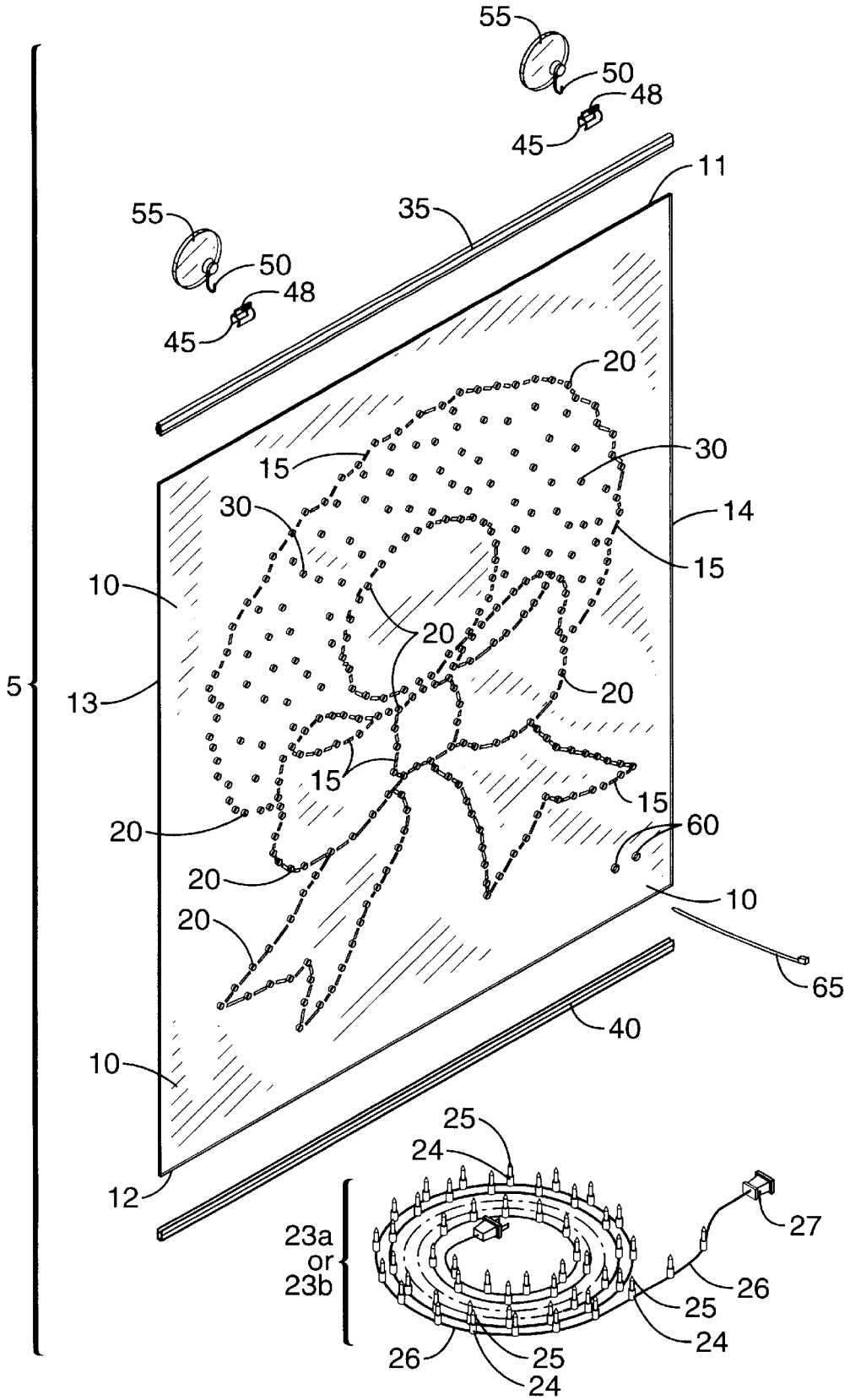
FIG. 1 is an exploded view of the subject invention.
Figure 2:
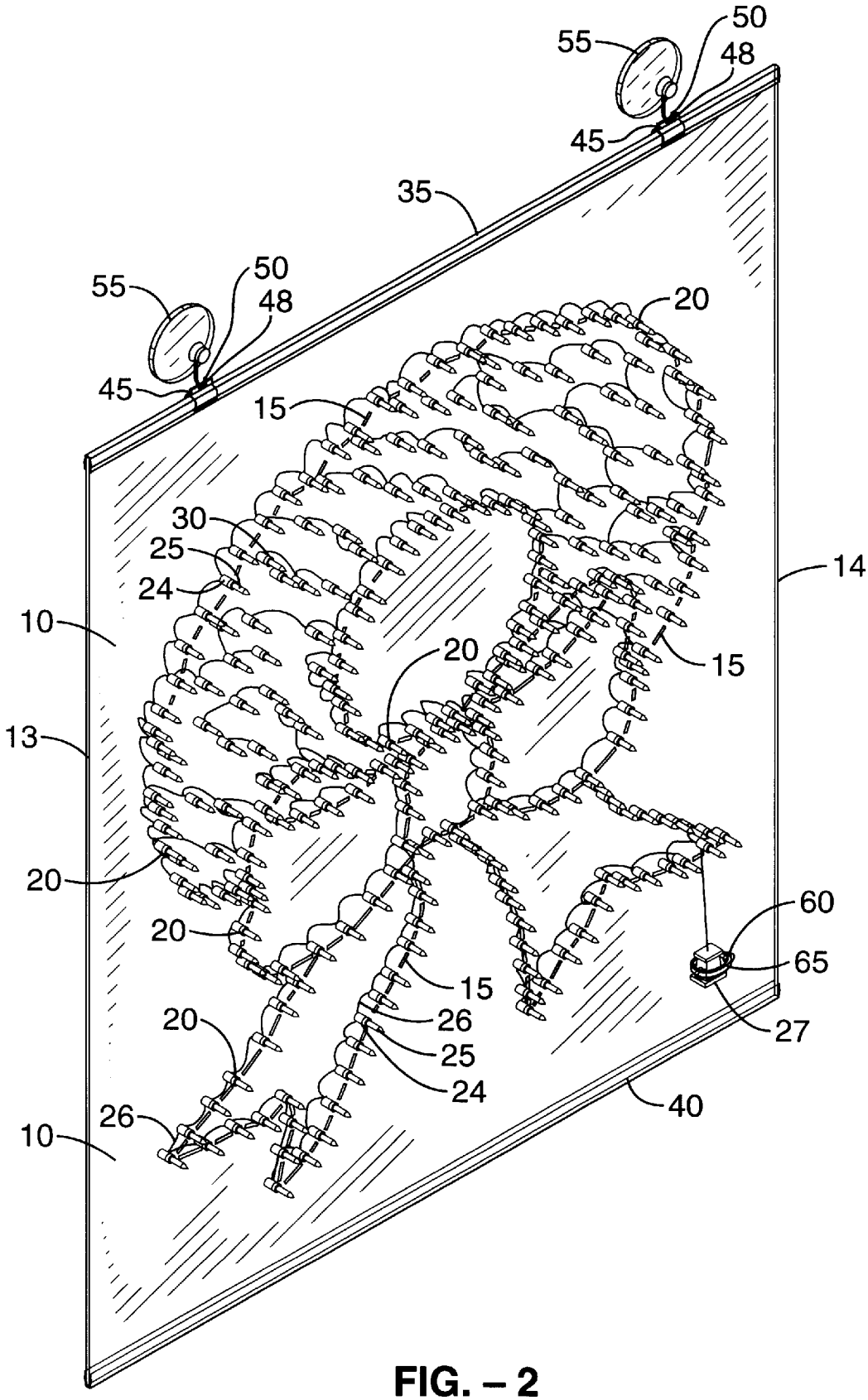
FIG. 2 is a perspective view of the subject invention.
Figure 3:
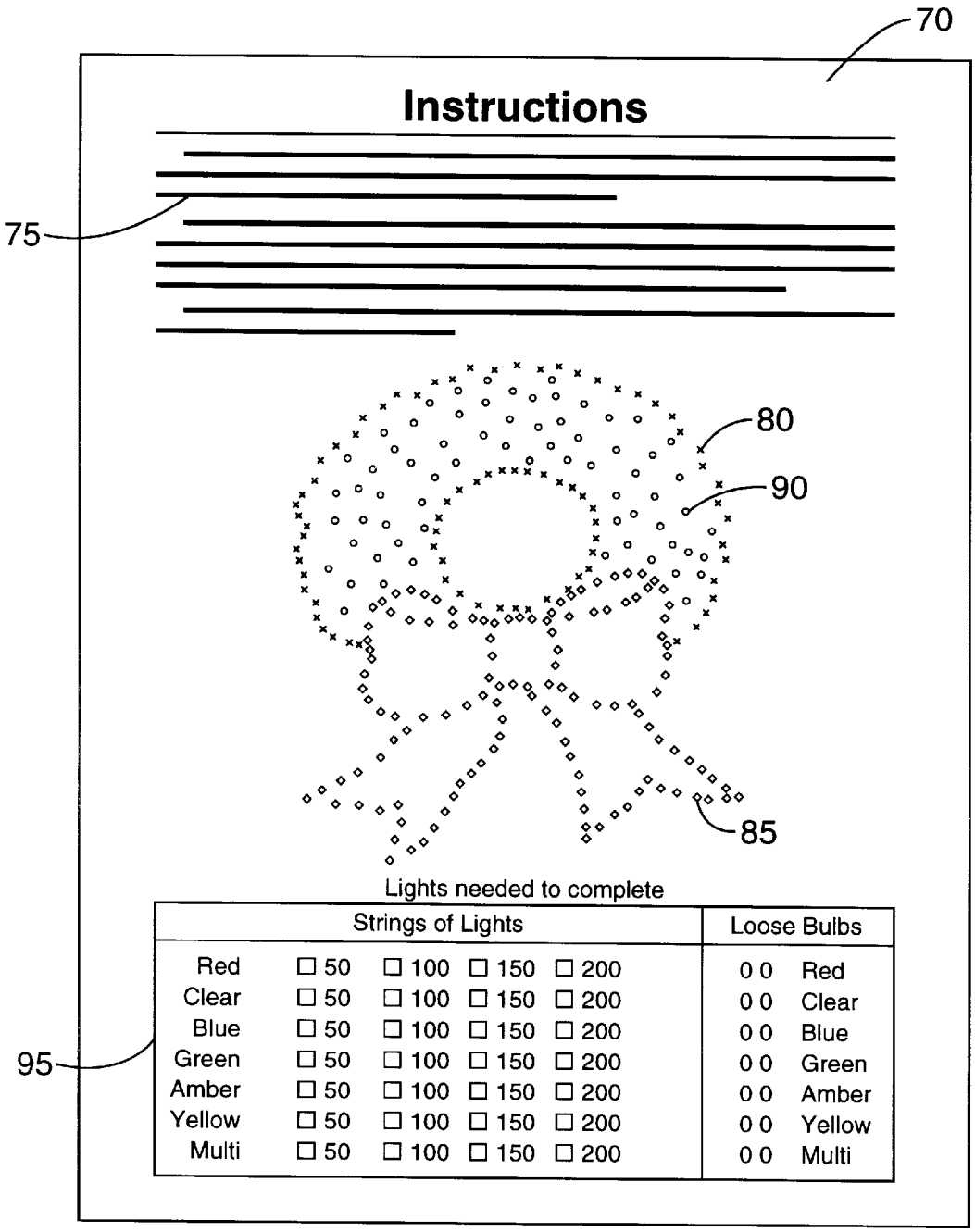
FIG. 3 is a perspective view of the instructional means of the subject invention.

Depicted in FIG. 1 is an exploded view of the subject lighting decoration 5. Comprising the decoration 5 is a display sheet fabricated from a transparent and resilient film 10. Since the film is transparent, daylight may enter through the subject decoration if it is mounted in a window. Commonly, the film 10 is fabricated from natural or synthetic polymers such as polyvinyl chloride (PVC) or the equivalent. The film 10 material must be flexible enough to compact easily, yet sturdy enough to weather well and to hold or firmly grasp the lights by means of its resiliency or elasticity. Although other substances are contemplated as being within the realm of this disclosure, a PVC sheet has been found to be an ideal film 10 for the subject invention. The thickness of the film is usually about one sixteen inch but may vary from thinner to thicker dimensions or from about one sixty-fourth inch or less to about one quarter inch or more. The generally used film 10 of about one sixteen inch thickness easily rolls into a compact cylinder for shipping or storage, but securely hold a light string and endures outdoor use.

The overall, outer, or perimeter shape of the film 10 may have any desired form from rectangular, as shown in FIG. 1, to circular or other configuration. The rectangular shape depicted in FIG. 1 has an upper edge 11 and a lower edge 12, along with two opposing side edges 13 and 14.

An outline 15 of the predetermined shape is denoted or marked on the film 10. FIG. 1 shows the outline 15 of a typical Christmas wreath. Standard techniques are utilized to mark the outline 15 shape on the film 10 such as silk screening, inking, melting, painting, staining, and the like. The outline 15 is usually applied in a stripe that is about one quarter inch wide, however, narrower or broader lines are acceptable and may be applied in neutral or colored shades to emphasize the pattern of the lights for assembly or to indicate the exact color of lights to be placed at a specific location.

Primary apertures 20 are formed in the film 10 along the outline 15 and are either directly on or proximate to the outline 15 image. The primary apertures 20 are used to hold or support at least one primary string of lights 23*a*. The primary string of lights 23*a* (as well as the secondary string of lights 23*b* discussed below) is of the type generally termed "miniature" lights which comprises specifically adapted light bulb sockets 24 (see below and in FIGS. 4 and 5 for details of these film or panel gripping sockets), light bulbs 25, wiring 26, and a plug 27. Each aperture 20 is formed in the film 10 by traditional methods such as by punching, melting, forming during the polymerization of the polymer sheet, drilling, and the like. For the depicted example (see FIGS. 1 and 2), the apertures 20 are punched to an approximate opening diameter of about five-sixteenth inch. The diameter of the aperture 20 needs to be such that the panel gripping light bulb socket 24 containing the light bulb 25 is retained within the aperture by means of the resilience or elasticity of the film 10 and the retection means formed in the film or panel gripping sockets 24. As the socket 24 is inserted within the aperture 20, the film 10 exerts a resilience or elasticity generated force on the socket 24, thereby retaining it within the aperture in cooperation with the retention means detailed further below (see FIGS. 4 and 5).

For the example wreath shown in FIG. 1, one primary string of lights 23*a* might be an all green string and positioned to cover the inner and outer outline of the circular leafy part of the wreath and another primary string of lights 23*a* might be an all red string and positioned to cover the outline of the bow, thereby producing a two color illuminated image.

Secondary apertures 30 are formed in the film 10 in an equivalent manner to the method utilized with the primary apertures 20. At least one string of secondary lights 23*b* is held within the secondary apertures 30. The secondary apertures are positioned either within or outside of the outline 15 image marked on the film 10. The purpose of the secondary string of lights 23*b* fitted within the secondary apertures 30 is to highlight or emphasize the appearance of the predetermined outline 15 image. As indicated above, the outline 15 in the example wreath in FIG. 1 might be lighted in green and red lights while the interior of the green portion may have mixed color lights that serve as ornaments. Clearly, the exact color combinations for the primary and secondary lights can be varied from a standard supplied color scheme to any random pattern.

As with each primary string of lights 23*a* and its receiving apertures 20, each secondary string of lights 23*b* pressure fits within its accepting apertures 30 and is releasable or removable in the sense that the film or panel gripping sockets 24 may be removed from the film 10 to change a color pattern or to store the device.

Since the resilient film 10 is not rigid it may distort and not position itself in a planar orientation. To smooth the surface of the film 10 and to provide additional support, upper 35 and lower 40 support strips are supplied. Usually, the upper support strip 35 is "U" shaped and pressure fits over the upper edge 11 of the film 10. The upper edge 11 is slid within the retaining "U" shaped groove. The pressure exerted by the upper support strip 35 upon the upper edge 11 is sufficient to provide an anchor point for suspending or hanging the device, but may be removed from the film 10 by suitable leverage and pushing or pulling. Likewise, the lower edge 12 is retained within the "U" shaped grove of the lower support strip. Other equivalent means for strengthening and flattening the film 10 are considered to be provided in this disclosure. Clearly, if the perimeter shape of the film 10 is not rectangular, as the depicted example (see FIGS. 1 and 2), an appropriate modification of the upper 35 and lower 40 support strips would need to be made.

Means for hanging or mounting the subject film 10 are provided. Usually, the hanging means are one or more clips 45 that releasably fasten to the upper support strip 35. The clips illustrated in FIGS. 1 and 2 pressure fit about the outer form of the upper support strip 35. Coupling means are included in the clips 45 and are depicted as openings 48 for receiving a hook member 50. Each hook member 50 may in turn be constructed and configured to hook to a supporting wall, frame, easel, tree, house structural component, and the like. On exemplary form the hook member may be adapted to mate with is a suction cup member 55 that releasably attaches to the surface of a window pane (shown in FIGS. 1 and 2).

As described above, the apertures 20 and 30 retain the film or panel gripping bulb housings or sockets 24 for each string of lights 23*a* or 23*b* fitted to the film 10. However, the terminal plug 27 is anchored or secured to the film 10 by means that allow the user to power the lights without having the weight of the power cord extracting the lights from the film 10. Usually, a pair of anchoring apertures 60 are placed in the film 10, generally near the lower edge 12. Retention means are provided for securing the terminal plug 27 to the film 10 via the pair of anchoring apertures 60. A suitable plug retention means comprises a tie member 65 that loops through the anchoring apertures 60 and about the plug 27 in a securing manner. Although the force of the socket-to-aperture mating in the primary and secondary lighting strings is usually sufficient to hold interior plugs that connect multiple light strings together, interior plug anchoring means similar to the terminal plug 27 approach may be utilized for the interior plugs.

Preferably, the subject device is supplied in the form of a kit that contains the components needed for assembling the subject invention. The subject kit contains the display sheet (outlined 15 and aperture 20 and 30 containing film 10), one or more strings of lights 23*a* and 23*b*, an appropriate number of support strips 35 and 40, means for hanging the subject device, and means for instructing the user in assembling the subject lighting decoration. Usually, the means for instructing the user comprises an instruction manual or an instruction sheet 70 depicted in FIG. 3. Comprising the preferred instruction sheet are regions for: 1) a statement 75 concerning general procedures such as the insertion of the specified colored light containing sockets into the indicated apertures, fastening the plug to the film, hanging instruction, and the like; 2) a color chart of the outlined image with, for example, green lights at the crosses 80, red lights at the triangles 85, and mixed colored lights at the circles 90; and 3) "lights included in this container" region 95 for indicating exactly what color and bulb count exist for the strings of lights included in the kit. Additional relevant information may be noted in the instructional means, including storage techniques, replacement of non-functioning bulbs, assembly games created to add enjoyment to the creative process, event, or holiday, and the like.

Figure 4:
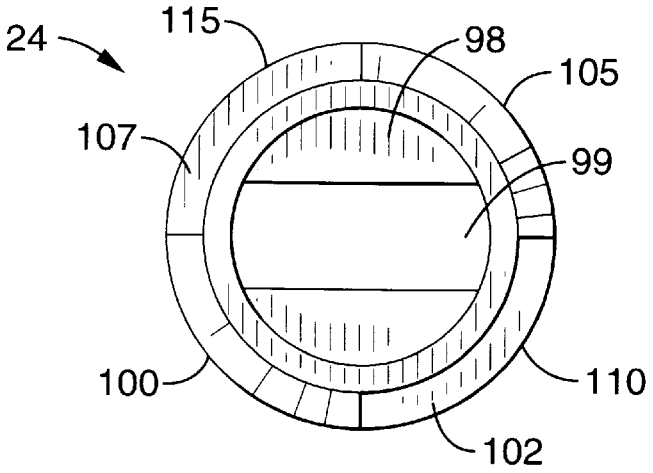
FIG. 4 is a side view of the subject socket showing first and second means for releaseably fastening to the supporting film.
Figure 5:
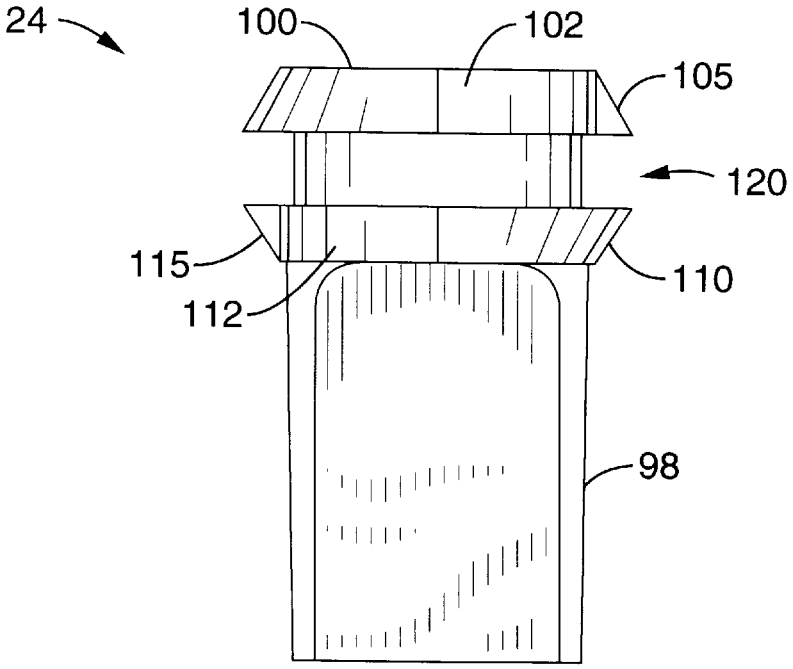
FIG. 5 is a top view of the subject socket showing first and second means for releaseably fastening to the supporting film.

FIGS. 4 and 5 specifically detail the socket 24 utilized in both the primary and secondary light strings 23*a* or 23*b*. Attached to a central body 98 that has a central bulb holding aperture 99 is an upper or first gripping means comprising two opposing and projecting ribs 100 and 105 separated by gaps 102 and 107. Also attached to the central body 98 is a lower or second gripping means comprising another two opposing and projecting ribs 110 and 115 separated by gaps 112. Preferably, the outer borders or edges of all of the upper and lower ribs are angled or sloped as seen in FIGS. 4 and 5. The first ribs 100 and 105 are staggered approximately 90° over the second ribs 110 and 115, thereby producing for each rib above a gap immediately below or a gap above and a rib immediately below. This configuration generates a space 120 into which the film or panel fits and is gripped between the upper ribs 100 and 105 and the lower ribs 110 and 115. The gaps 102, 107, and 112 (the gap opposite gap 112 is not shown), in cooperation with the ribs 100, 105, 110, and 115 grip the film within the space 120 in a removable or releaseable manner. It is stressed that other equivalent configurations having three or more upper and three or more lower ribs are also considered to be within the realm of this disclosure.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A versatile lighting decoration, comprising:

a) a display sheet comprising:

i) a transparent and resilient film;

ii) an outline of a predetermined shape denoted on said transparent and resilient film;

iii) a plurality of first apertures positioned along said outline of said predetermined shape; and b) at least one string of primary lights comprising:

i) a plurality of bulbs connected together by wiring terminating in a plug and ii) a plurality of film gripping sockets for holding said plurality of bulbs, wherein each said film gripping socket comprises:

a bulb and wire receiving body having first and second ends, wherein said bulb extends from said first end and said wire extends from said second end;

a first film gripping means protruding from said bulb and wire receiving body; and a second film gripping means protruding from said bulb and wire receiving body.

2. A versatile lighting decoration according to claim 1, wherein said first film gripping means comprises a first set of ribs proximate said first bulb and wire receiving body end and said second film gripping means comprises a second set of ribs positioned toward said second bulb and wire receiving body end, wherein a distance between said first and said second set of ribs releaseably accomodates said transparent and resilient film.

3. A versatile lighting decoration according to claim 2, wherein said first and said second set of ribs each include an outer angled border.

4. A versatile lighting decoration according to claim 1, wherein said first film gripping means comprises a plurality of first ribs proximate said first bulb and wire receiving body end and said second film gripping means comprises a plurality of second ribs positioned toward said second bulb and wire receiving body end, wherein a distance between said first and said second ribs releaseably accomodates said transparent and resilient film.

5. A versatile lighting decoration according to claim 4, wherein said pluralities of first and second ribs include for each of said first and said second ribs an outer angled border.

* * * * *